US009915259B2

(12) United States Patent
Okamoto

(10) Patent No.: US 9,915,259 B2
(45) Date of Patent: Mar. 13, 2018

(54) APPARATUS FOR CONTROLLING ELECTRIC PUMP

(71) Applicant: Hitachi Automotive Systems, Ltd., Hitachinaka-shi, Ibaraki (JP)

(72) Inventor: Naoki Okamoto, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 386 days.

(21) Appl. No.: 13/798,293

(22) Filed: Mar. 13, 2013

(65) Prior Publication Data

US 2013/0251541 A1 Sep. 26, 2013

(30) Foreign Application Priority Data

Mar. 21, 2012 (JP) ..... 2012-064153

(51) Int. Cl.
*F04B 49/06* (2006.01)
*F04B 49/20* (2006.01)

(52) U.S. Cl.
CPC ..... *F04B 49/06* (2013.01); *F04B 49/20* (2013.01); *F04B 2205/10* (2013.01)

(58) Field of Classification Search
CPC ..... F04B 49/06; F04B 49/20; F04B 2205/10
USPC ..... 417/42, 32, 44.1, 45, 4.1; 318/400.32, 318/634, 641
See application file for complete search history.

(56) References Cited

U.S. PATENT DOCUMENTS 6,825,626 B2 * 11/2004 Peterson ..... A47L 15/4293 310/DIG. 6
7,290,989 B2 * 11/2007 Jayanth ..... F04C 23/008 417/44.1
7,342,763 B2 * 3/2008 Mladenik ..... H02H 3/00 361/119
7,477,058 B2 * 1/2009 Montreuil ..... G01R 15/202 324/117 H (Continued)

FOREIGN PATENT DOCUMENTS

EP 2 428 706 A1 3/2012
JP 2010-180731 A 8/2010
JP 2012-62909 A 3/2012

OTHER PUBLICATIONS

Japanese Office Action issued in counterpart Japanese Application No. JP 2012-064153 dated Aug. 4, 2015, with English translation (Seven (7) pages).

*Primary Examiner* — Devon Kramer
*Assistant Examiner* — Connor Tremarche
(74) *Attorney, Agent, or Firm* — Crowell & Moring LLP

(57) ABSTRACT

In an apparatus for controlling an electric pump supplying operating oil to a driving system or the like of a vehicle, control satisfying both responsiveness and reduction in power consumption is performed even in a case in which an oil temperature sensor and a pump characteristic are abnormal. After starting of the electric pump, feedback control is performed in which a rotation number Nm of a driving motor is settled in a target rotation number Na set to satisfy predetermined performance. After satisfying a predetermined condition in which the motor rotation number Nm is in a stable state, motor current Im is settled in an indicated current Ip within a range of being equal to or less than a current limit value IL while the motor rotation number Nm (Continued)

is maintained equal to or greater than a required rotation number Np corresponding to the indicated current Ip.

20 Claims, 12 Drawing Sheets

(56) References Cited

U.S. PATENT DOCUMENTS

| | | | | |
|---|---|---|---|---|
| 2007/0052382 | A1* | 3/2007 | Nomura | H02P 6/08 318/400.08 |
| 2008/0153661 | A1* | 6/2008 | Shibata | B60K 6/445 477/3 |
| 2011/0084638 | A1* | 4/2011 | Patel | B60K 1/02 318/400.32 |
| 2011/0118937 | A1* | 5/2011 | Kariatsumari | B62D 5/046 701/41 |
| 2012/0062164 | A1* | 3/2012 | Sano | F16H 61/0031 318/721 |

* cited by examiner

APPARATUS FOR CONTROLLING ELECTRIC PUMP

BACKGROUND OF THE INVENTION

1. Field of the Invention

The present invention relates to an apparatus and a method for controlling an electric pump supplying operating oil to a driving system or the like of a vehicle.

2. Description of Related Art

As for an electric pump of this kind, Japanese Patent Laid-Open (Kokai) Application Publication No. 2010-180731 discloses a technique of controlling the electric pump by setting target values of current and a rotation number of a driving motor based on a detected operating oil temperature (oil temperature).

However, in Japanese Patent Laid-Open (Kokai) Application Publication No. 2010-180731, in a case in which an oil temperature detected by an oil temperature sensor is in an operating oil temperature range but indicates an abnormal value having a marked difference from an actual oil temperature, or in a case in which friction as a pump characteristic increases due to deterioration, it is difficult to detect these abnormalities, and there is a problem in which motor control is abnormal.

Also, it is difficult to satisfy both securement of responsiveness and reduction in power consumption even in a case in which the oil temperature sensor and the pump characteristic are normal.

SUMMARY OF THE INVENTION

The present invention is accomplished by taking such conventional problems into consideration thereof, and an object thereof is to provide an apparatus for controlling an electric pump enabling to secure required pump performance even in a case in which an oil temperature sensor and a pump characteristic are not normal and enabling to satisfy both securement of responsiveness and reduction in power consumption not only in an abnormal case but also in a normal case.

To achieve the above object, an apparatus for controlling an electric pump supplying operating oil according to the present invention is configured to include the following components:

a reference pump characteristic setting unit setting a reference pump characteristic, which is relationship between required current and a required rotation number of a motor for driving the electric pump required to obtain predetermined pump performance in accordance with a temperature of the operating oil, an indicated current setting unit setting the required current as indicated current from the reference pump characteristic in accordance with a detected temperature of the operating oil, and a control unit controlling a motor rotation number with a rotation number securing pump performance equal to or greater than the predetermined pump performance as a target rotation number in an initial stage of pump starting and, when the motor rotation number is greater than the required rotation number corresponding to the indicated current after settlement in a predetermined state by the motor rotation number control, settling motor current in the indicated current within a range in which the motor rotation number is maintained equal to or greater than the required rotation number.

Also, a method of controlling an electric pump supplying operating oil according to the present invention is configured to include the following steps:

setting a reference pump characteristic, which is relationship between required current and a required rotation number of a motor for driving the electric pump required to obtain predetermined pump performance in accordance with a temperature of the operating oil, setting the required current as indicated current from the reference pump characteristic in accordance with a detected temperature of the operating oil, and controlling a motor rotation number with a rotation number securing pump performance equal to or greater than the predetermined pump performance as a target rotation number in an initial stage of pump starting and, when the motor rotation number is greater than the required rotation number corresponding to the indicated current after settlement in a predetermined state by the motor rotation number control, controlling motor current to be settled in the indicated current within a range in which the motor rotation number is maintained equal to or greater than the required rotation number.

Other objects and features of an aspect of the present invention will be understood from the following description with reference to the accompanying drawings.

DESCRIPTION OF THE PREFERRED EMBODIMENTS

Hereinafter, embodiments in which the present invention is applied to an electric pump which supplies operating oil (operating fluid) for lubrication and cooling to a continuously variable transmission of a vehicle will be described.

Figure 1:
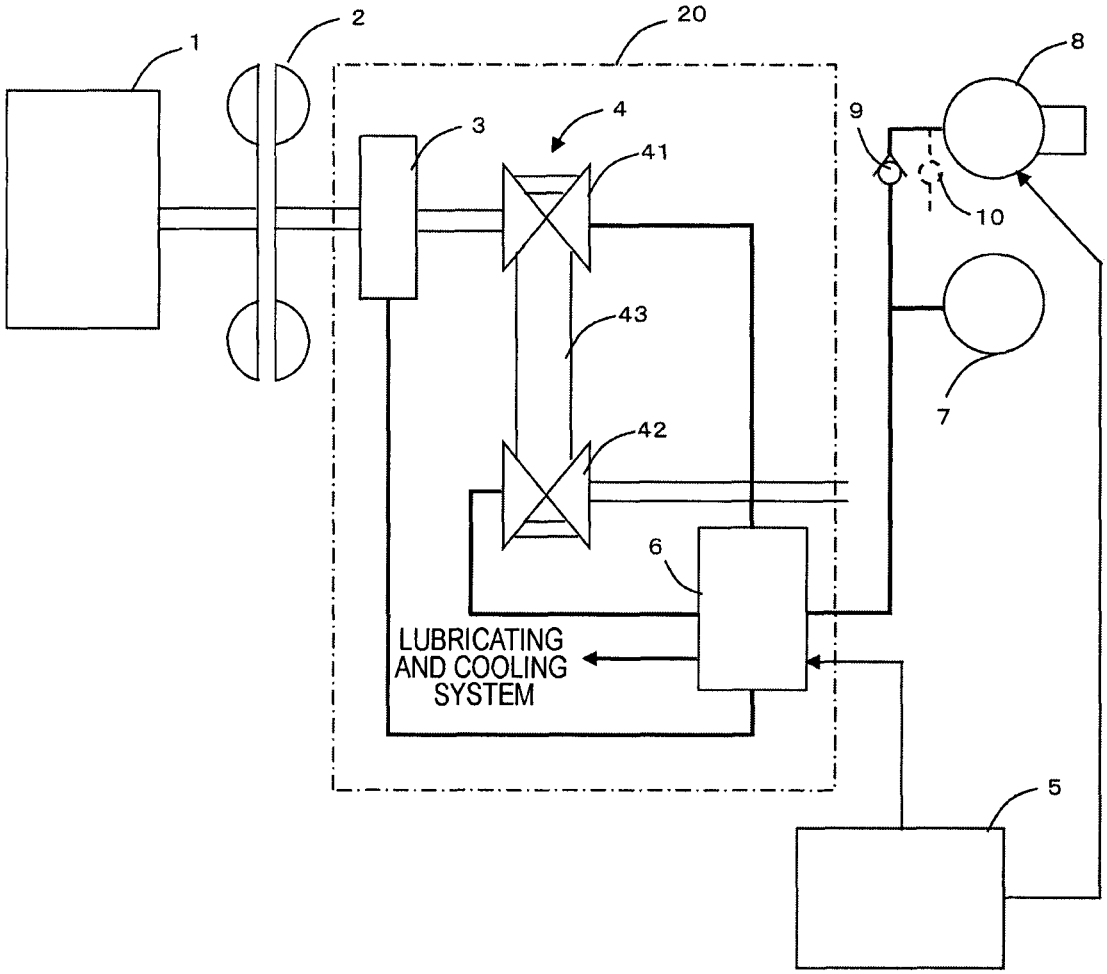
FIG. 1 illustrates a driving force transmitting system of a vehicle including an electric pump according to an embodiment.

In FIG. 1, an engine (internal combustion engine) 1 is connected to a continuously variable transmission 4 via a torque converter 2 and a backward and forward/reward switching mechanism 3 as a startup clutch.

Backward and forward/reward switching mechanism 3 switches between forward movement and backward movement of the vehicle, and includes, for example, a planetary gear train including a ring gear, a pinion and a pinion carrier jointed to an engine output shaft, and a sun gear jointed to a transmission input shaft, a backward brake which fixes a transmission case to the pinion carrier, and a forward clutch which couples the transmission input shaft and the pinion carrier. Switching between the backward brake and the forward clutch is carried out by switching fastening by means of a hydraulic pressure using operating oil shared by continuously variable transmission 4.

Continuously variable transmission 4 includes a primary pulley 41, a secondary pulley 42, and a V belt 43 provided between these pulleys. Rotation of primary pulley 41 is transmitted to secondary pulley 42 through V belt 43, and rotation of secondary pulley 42 is transmitted to driving wheels to drive the vehicle to run.

While the driving force is transmitted, a movable conical plate of primary pulley 41 and a movable conical plate of secondary pulley 42 are moved in a shaft direction to change the radius of position contacting with V belt 43, so that it is possible to change a transmission gear ratio between primary pulley 41 and secondary pulley 42, that is, a rotational ratio.

A transmission mechanism 20 including backward and forward/reward switching mechanism 3 and continuously variable transmission 4 is controlled in the following manner.

A CVT control unit 5 which is an external device calculates a transmission control signal based on various signals of the vehicle, and a pressure adjustment mechanism 6 which receives the transmission control signal adjusts a discharge pressure from a mechanical pump 7 driven by an engine per each part of transmission mechanism 20 and supplies the pressure to each part.

A passage to bypass mechanical pump 7 is provided with an electric pump 8. Electric pump 8 is driven by a control signal from CVT control unit (CVTCU) 5, serving as the external device, to alleviate fastening shock at the time of restart of the vehicle after idling stop or to lubricate and cool respective lubricated parts.

In addition, if necessary, the oil passage at an outlet of electric pump 8 may be provided with a check valve 9 which prevents back-flow of operating oil in a normal state. Furthermore, as indicated by single dotted chain line in FIG. 1, a relief valve 10 which is opened at predetermined pressure or less may be provided so as to limit discharge pressure from electric pump 8 to the predetermined pressure or less.

Figure 2:
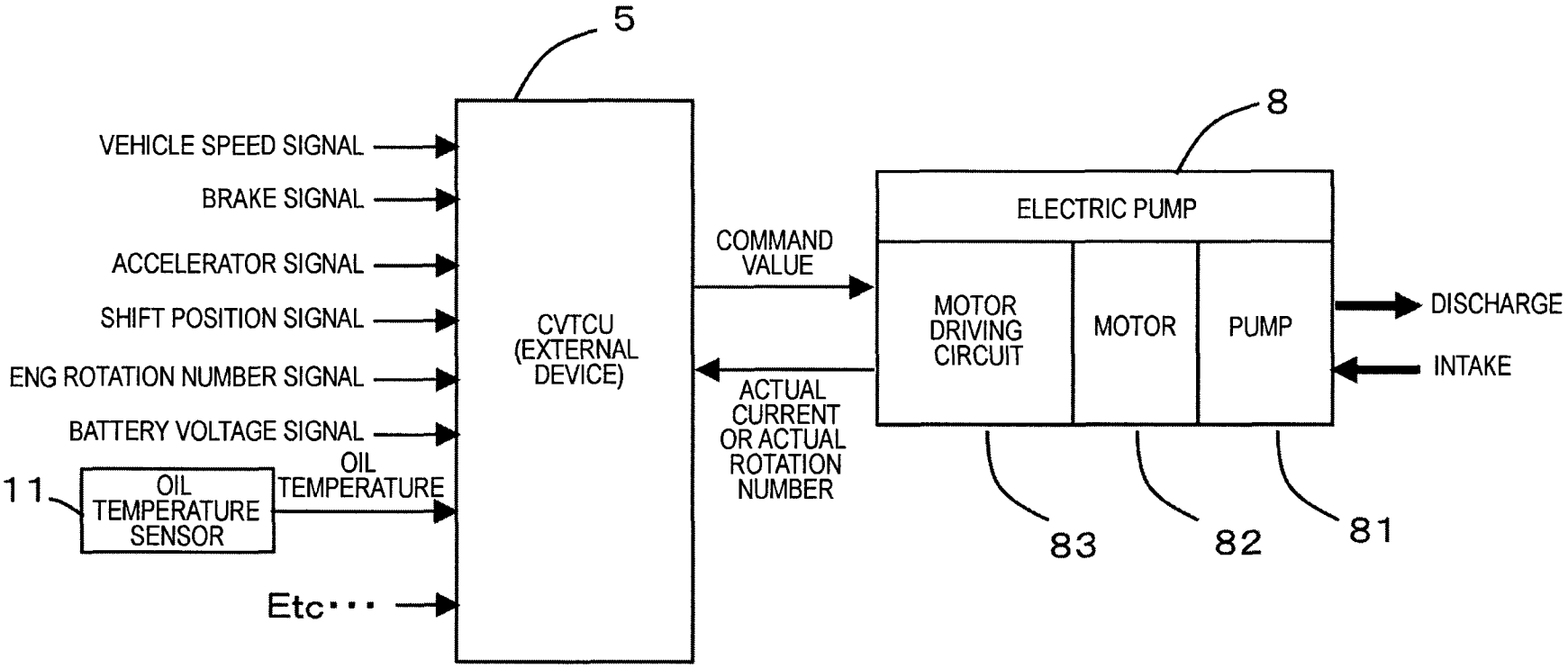
FIG. 2 is a control block diagram for the electric pump.

FIG. 2 illustrates a control block diagram for the electric pump.

CVTCU 5 receives detection signals (vehicle speed, brake, accelerator, shift position, engine rotating speed, battery voltage, etc.) from various sensors of the vehicle, and a temperature of operating oil (oil temperature) measured by an oil temperature sensor 11. Based on the detected oil temperature, CVTCU 5 calculates a command value (indicated current of a driving motor) corresponding to hydraulic pressure required for electric pump 8 and outputs the indicated current as a command value to electric pump 8.

Electric pump 8 includes a pump main body 81, a motor 82 which drives pump main body 81, and a motor driving circuit 83 which drive motor 82.

Motor driving circuit 83 detects motor current Im (actual current) and a motor rotation number Nm (actual rotation number: pump rotation number) to send them to CVTCU 5 and drives motor 82 based on the command value from CVTCU 5, thus to achieve after-mentioned control according to the present invention.

Figure 3:
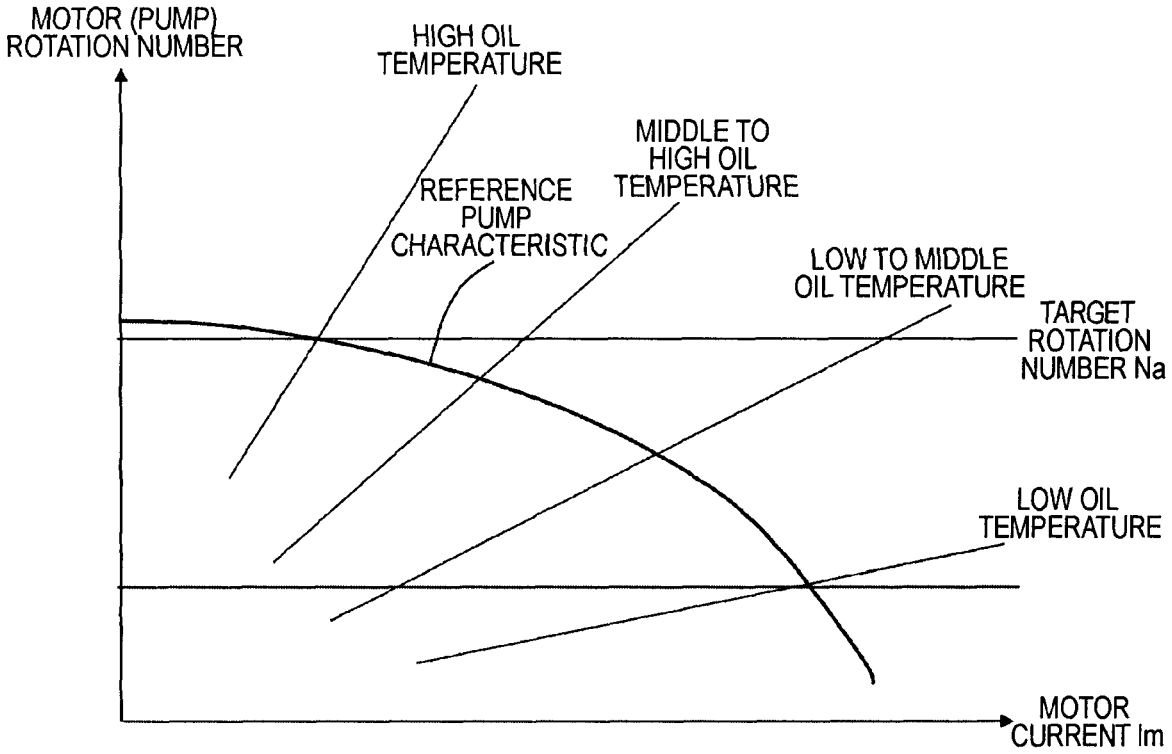
FIG. 3 illustrates relationship between current and a rotation number of a motor for pump driving enabling to obtain predetermined pump performance.

CVTCU 5 and motor driving circuit 83 have stored in internal memories thereof a reference pump characteristic, which is relationship between current and a rotation number of motor 82 required to obtain predetermined pump performance in accordance with a temperature of operating oil as illustrated in FIG. 3. It is to be noted that CVTCU 5 and motor driving circuit 83 may have stored therein only current required in accordance with the temperature.

The aforementioned predetermined pump performance is performance enabling to obtain required hydraulic pressure.

In a case of a high oil temperature, viscosity of operating oil is low, and the leak amount of the operating oil from an inside of the pump to a hydraulic pressure supply part (clutch) is large. Thus, a rotation number of the motor enabling to secure required hydraulic pressure (required rotation number) is greater while motor current required to secure the required hydraulic pressure is smaller since rotational resistance of the motor is smaller due to low operating oil viscosity.

On the other hand, in a case of a low oil temperature, viscosity of operating oil is high, and the leak amount of the operating oil is small, which is opposite to the above case. Thus, a required rotation number enabling to secure required hydraulic pressure is smaller while motor current required to secure the required hydraulic pressure is greater since rotational resistance of the motor is greater due to high operating oil viscosity.

Accordingly, the reference pump characteristic enabling to obtain the predetermined pump performance is a characteristic in which the required rotation number decreases along with an increase of the motor current.

Next, conventional control based on a value detected by an oil temperature sensor will be described. The control is carried out with current set from a reference pump characteristic (for example, refer to FIG. 3) based on an oil temperature detected by an oil temperature sensor as indicated current. In this case, in a case where a detected oil temperature corresponds to an actual oil temperature, a required rotation number on the reference pump characteristic is obtained, and predetermined pump performance is obtained.

However, in a case where the detected oil temperature is higher than the actual oil temperature, indicated current set from the reference pump characteristic based on the detected oil temperature is lower than current corresponding to the actual oil temperature. In this case, a rotation number of the motor is less than a required rotation number corresponding to the actual oil temperature, and thus the predetermined pump performance cannot be secured.

On the other hand, in a case where the detected oil temperature is lower than the actual oil temperature, indicated current is higher than current corresponding to the actual oil temperature. In this case, a rotation number is greater than a required rotation number corresponding to the actual oil temperature, and the predetermined pump performance can be secured, but loss of power consumption increases due to the greater rotation number than the required rotation number.

Also, even in a case where the rotation number is limited within a normal range, the rotation number is limited in a region lower than the reference pump characteristic line, which causes a case in which the predetermined pump performance cannot be obtained.

The aforementioned problem of the conventional control can be solved by the following control according to embodiments.

An overview of basic control common to the following embodiments will be described. In an initial stage of electric pump 8 starting, control of a rotation number is carried out with a rotation number, enabling to obtain pump performance equal to or greater than predetermined pump performance obtained with the above reference pump characteristic at an arbitrary oil temperature in an operating oil temperature range, as a target rotation number.

In a case where a rotation number of the motor settled in a predetermined state such as a stable state by the above rotation number control is greater than a required rotation number corresponding to indicated current, motor current is settled in the indicated current to the extent that the rotation number of the motor is maintained equal to or greater than the required rotation number. In other words, motor current Im is got closer to indicated current Ip to the extent that the rotation number of the motor satisfies the required rotation number.

Hereinafter, control according to each embodiment will be described.

Figure 4:
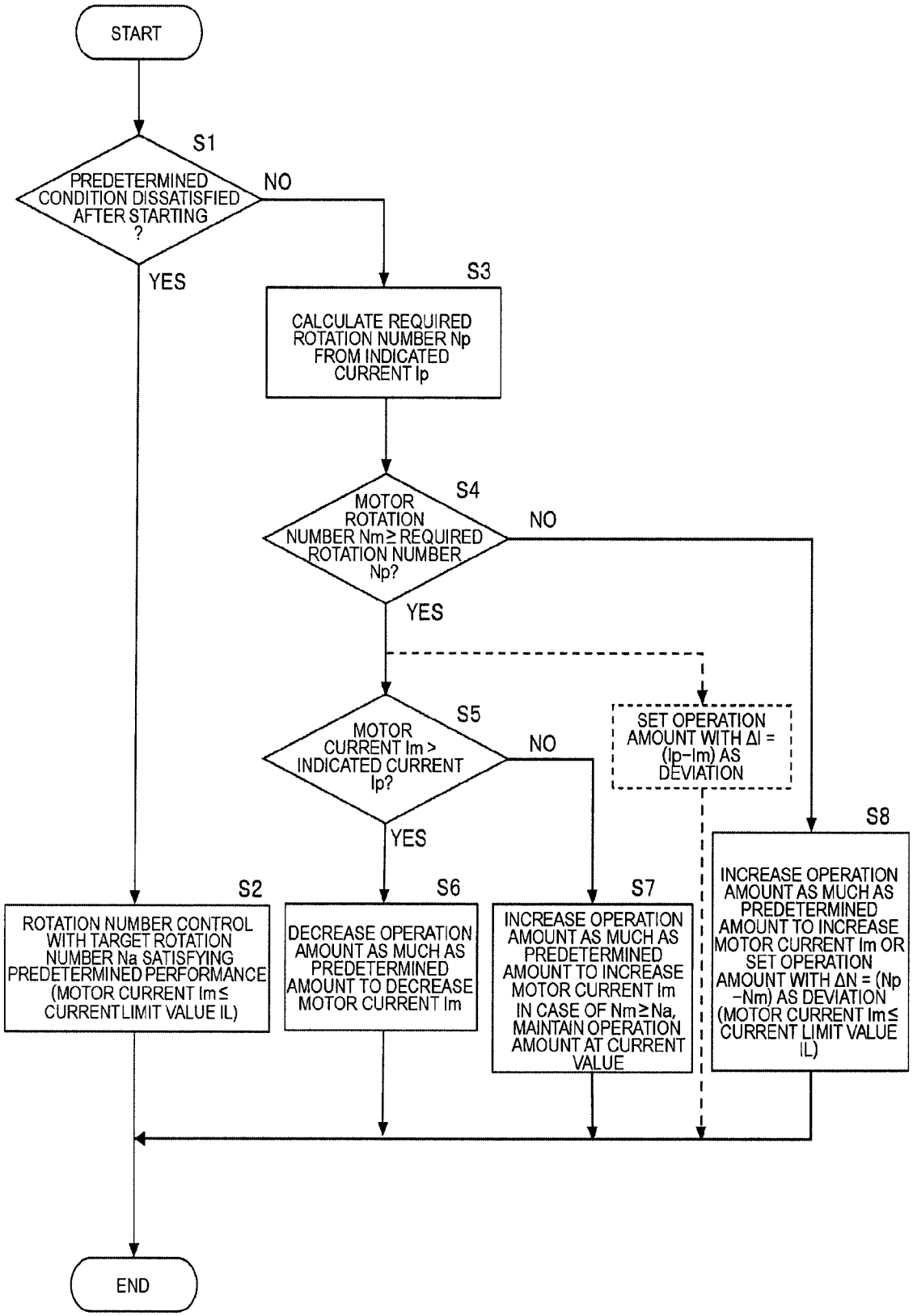
FIG. 4 is a flowchart of control according to a first embodiment.

FIG. 4 is a flowchart of a first embodiment illustrating basic control.

At step S1, it is determined whether a predetermined condition is dissatisfied after electric pump 8 starting. Here, satisfaction of the predetermined condition means settlement in a predetermined state by after-mentioned control of a rotation number at step S2. Since the predetermined condition is not satisfied in an initial stage of the pump starting, determination of step S1 is YES, and the procedure goes to step S2. For example, satisfaction of the predetermined condition can be determined by a stable state of a rotation number of the motor, engine stop, a stable state of pump discharge pressure, lapse of a predetermined period after starting the pump, or the like.

At step S2, a target rotation number Na enabling to secure pump performance equal to or greater than predetermined performance represented by the reference pump characteristic illustrated in FIG. 3 is set, and feedback rotation number control is carried out in which a motor rotation number Nm is settled in the target rotation number Na. The target rotation number Na has only to be set to a upper limit rotation number in a rotation number range satisfying the reference pump characteristic, for example, so that pump performance equal to or greater than predetermined pump performance can be obtained at an arbitrary oil temperature. During the rotation number control, the motor current Im is limited to a current limit value IL or less. This current limit value IL is set to upper limit current in a motor (pump) operating region.

When the motor rotation number Nm is settled in a stable state after execution of the rotation number control at step S2, determination of step S1 is NO, and the procedure goes to step S3.

At step S3, a required rotation number Np is calculated from indicated current Ip output from CVTCU 5 based on the reference pump characteristic. Here, CVTCU 5 outputs current on the reference pump characteristic at an oil temperature detected by oil temperature sensor 11 as the indicated current Ip. Electric pump 8 (driving circuit 83) calculates a rotation number on the reference pump characteristic at the indicated current Ip as the required rotation number Np. It is to be noted that electric pump 8 may calculate a greater rotation number than the required rotation number Np on the reference pump characteristic as the required rotation number Np.

At step S4, it is determined whether the motor rotation number Nm detected by driving circuit 83 is greater than the required rotation number Np. When it is determined that the motor rotation number Nm is greater than the required rotation number Np, the procedure goes to step S5.

At step S5, it is determined whether the motor current Im detected by electric pump 8 (driving circuit 83) is greater than the indicated current Ip output from CVTCU 5.

When it is determined at step S5 that the motor current Im is greater than the indicated current Ip, the procedure goes to step S6, and an operation amount is decreased as much as a predetermined amount to decrease the motor current Im. That is, the motor current Im is settled to be closer to the indicated current Ip.

In this manner, when the motor current Im is continued to be decreased and is thus the indicated current Ip or less while the motor rotation number Nm is maintained greater than the required rotation number Np, determination of step S5 is NO, and the procedure goes to step S7.

At step S7, the operation amount is increased as much as a predetermined amount to increase the motor current Im. When the increased motor current Im exceeds the indicated current Ip, determination of step S5 is YES again, and the operation amount is decreased. Such repetition of the increase and decrease of the operation amount settles the motor current Im in the indicated current Ip. It is to be noted that, to restrict frequent repetition of the increase and decrease of the operation amount, hysteresis may be provided in a manner in which it is determined in determination at step S5 whether the motor current Im exceeds a value derived by adding a predetermined value ΔI to the indicated current Ip in a case where the motor current Im increases.

Also, instead of the control in which determination of step S5 is carried out, and in which the operation amount is increased or decreased at step S6 or S7, control may be carried out in which the operation amount is increased or decreased in accordance with a deviation ΔI (=Ip−Im) between the indicated current Ip and the motor current Im as illustrated by the dashed line in FIG. 4 to settle the motor current Im in the indicated current Ip.

When the oil temperature rises due to continued pump operation to cause the indicated current Ip to decrease, control of settling the motor current Im in the decreased indicated current Ip is repeated.

On the other hand, in a case where the motor rotation number Nm decreases due to the decrease of the motor current Im at step S6, and where the motor rotation number Nm goes down to the required rotation number Np or less before the motor current Im goes down to the indicated current Ip, determination of step S4 is NO, and the procedure goes to step S8.

At step S8, the operation amount is increased as much as a predetermined amount to increase the motor current Im. When the motor rotation number Nm increases due to the increase of the motor current Im, determination of step S4 is YES again, and the procedure goes to step S5.

In a case where the motor current Im exceeds the indicated current Ip at step S5 in a similar manner to the previous time, the operation amount is decreased as much as a predetermined amount to decrease the motor current Im at step S6. When the motor rotation number Nm decreases due to the decrease of the motor current Im, and determination of step S4 is NO again, the operation amount is increased at step S8, and the motor rotation number Nm is increased. Such repetition of the increase and decrease of the operation amount settles the motor rotation number Nm in the required rotation number Np.

In this manner, the motor current Im is settled in the indicated current Ip within a range in which the motor rotation number is maintained equal to or greater than the required rotation number Np.

Meanwhile, when the oil temperature rises in the above state, the required rotation number Np corresponding to the decreased indicated current Ip increases while the motor rotation number Nm increases due to a decrease of operating oil viscosity, and the motor rotation number Nm is settled in equilibrium to the increased required rotation number Np.

Also, at step S8, instead of increasing the operation amount as much as a predetermined amount, the operation amount may be increased in accordance with a deviation ΔN (=Np−Nm) between the required rotation number Np and the motor rotation number Nm to maintain the motor rotation number Nm equal to or greater than the required rotation number Np.

On the other hand, in a case where the motor rotation number Nm is less than the required rotation number Np when the predetermined condition at step S1 is satisfied in a manner such as the motor rotation number Nm is stable by the rotation number control at step S2, determination of step S4 is NO. This case is a case in which a detected oil temperature by oil temperature sensor 11 is higher than an actual oil temperature as described later, and the motor rotation number Nm does not need to be increased to the required rotation number Np corresponding to the indicated current Ip in accordance with the detected oil temperature. Accordingly, the procedure goes to step S8, and the operation amount is increased to cause the motor current Im to be increased, but by setting the current limit value IL similar to that at step S2, the motor current Im is maintained to be the current limit value IL or less.

In this case as well, when the indicated current Ip decreases along with subsequent rise of the oil temperature, the motor current Im decreases so as to get close to the decreased indicated current Ip and is settled.

Next, functions of the above control in different circumstances will be described.

Figure 5:
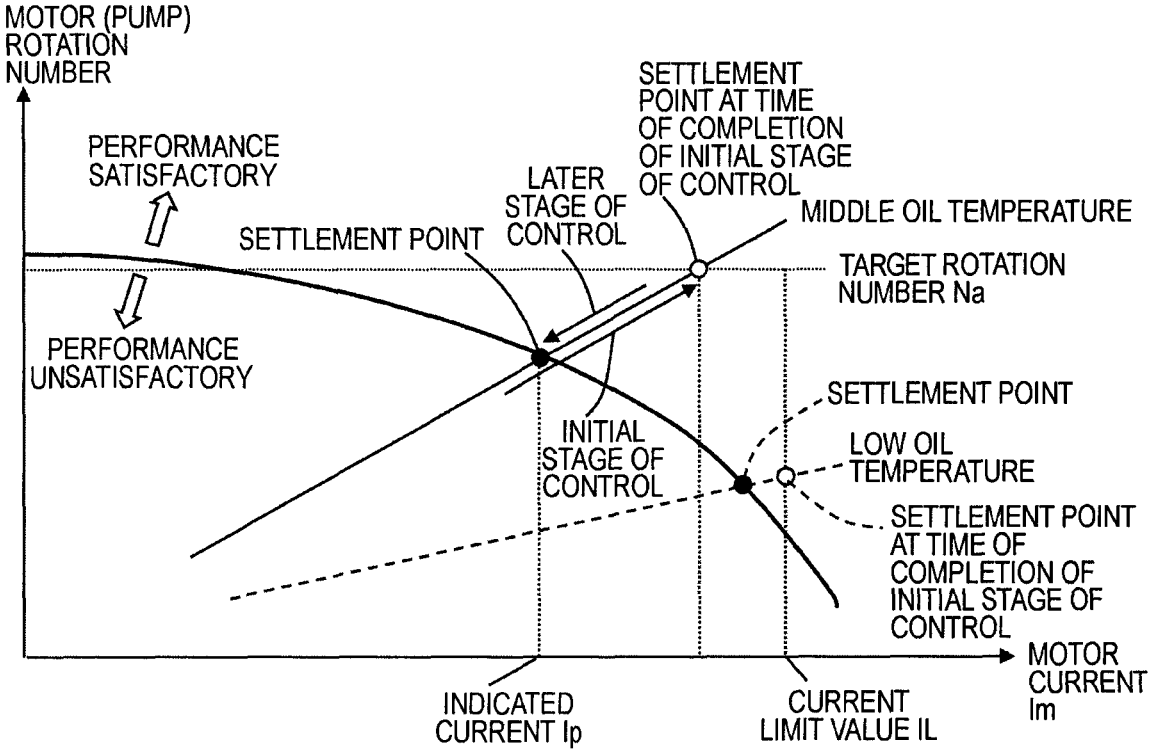
FIG. 5 illustrates pump operation when an electric pump control system is normal in the control according to the first embodiment.

FIG. 5 illustrates a circumstance when both oil temperature sensor 11 and the pump characteristic are normal. For example, when the actual oil temperature is a middle oil temperature (a middle temperature in a range from a low temperature to a high temperature), oil temperature sensor 11 detects the middle oil temperature in a normal range including detection variation, and electric pump 8 moves on a middle oil temperature characteristic line.

In the above rotation number control at step S2, in an initial stage of pump control, the motor rotation number Nm reaches the target rotation number Na, and in a later stage of the control after satisfaction of the predetermined condition, the motor current Im is settled in the indicated current Ip.

With such control, first, in an initial stage of the pump starting, by carrying out the feedback control by setting a higher target rotation number Na than the required rotation number Np corresponding to the indicated current Ip, increase speed of the motor rotation number Nm and thus an increase of hydraulic pressure can be accelerated to improve responsiveness as much as possible, and pump performance equal to or greater than predetermined one can be obtained.

Subsequently, by decreasing the motor current Im to the indicated current Ip enabling to secure predetermined pump performance, power consumption can be reduced as much as possible.

Also, in a case where the actual oil temperature is a low oil temperature, by limiting the motor rotation number Nm by the current limit value IL before the motor rotation number Nm reaches the target rotation number Na in control in an initial stage of the pump starting as illustrated by the dashed line in the figure, durability of electric pump 8 can be favorably maintained.

Meanwhile, in the normal circumstance, in a state in which oil temperature sensor 11 has no detection variation, the motor rotation number Nm is settled in the required rotation number Np approximately at the same time as the motor current Im is settled in the indicated current Ip. On the other hand, in a case where an oil temperature detected by oil temperature sensor 11 has variation with respect to the actual oil temperature to a high temperature side, the motor rotation number Nm reaches the required rotation number Np before the motor current Im reaches the indicated current Ip. Conversely, in a case where a detected oil temperature has variation with respect to the actual oil temperature to a low temperature side, the motor current Im reaches the indicated current Ip before the motor rotation number Nm reaches the required rotation number Np.

Figure 6:
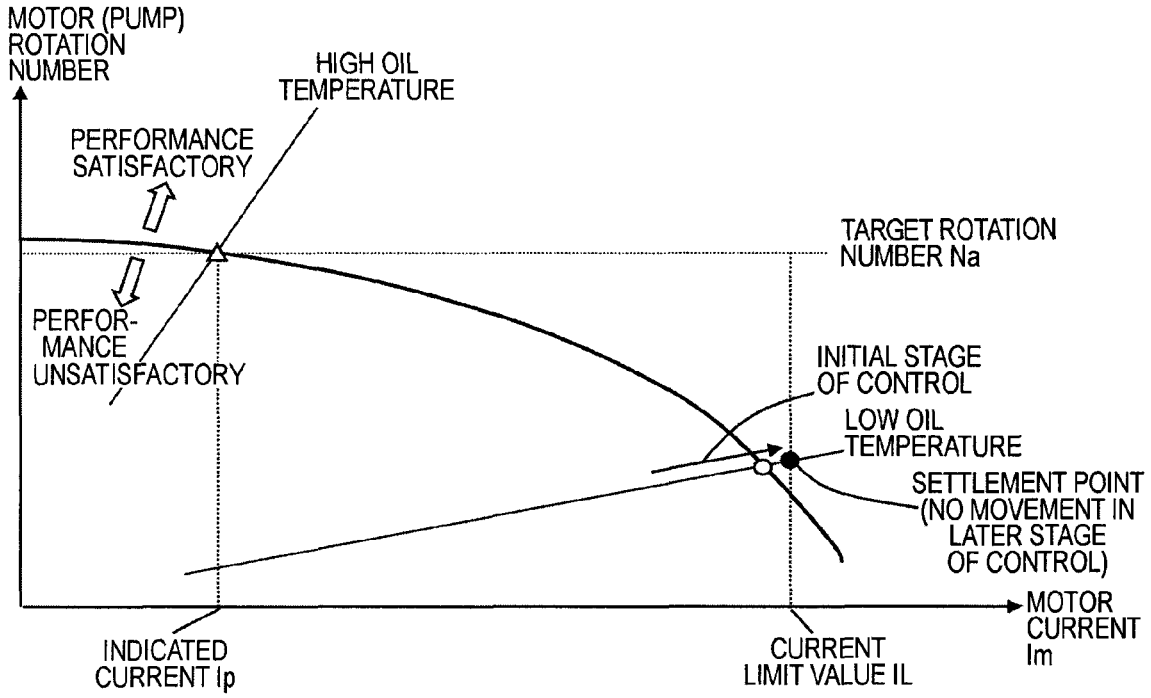
FIG. 6 illustrates pump operation when an oil temperature detected by a hydraulic pressure sensor is higher than an actual oil temperature in the control according to the first embodiment.

FIG. 6 illustrates a circumstance in which the oil temperature is detected as a high oil temperature due to abnormality of oil temperature sensor 11 although the actual oil temperature is a low oil temperature.

In the aforementioned control in an initial stage of the pump starting at step S2, the motor current Im is increased in order for the motor rotation number Nm to be increased toward the target rotation number Na on a low oil temperature characteristic line corresponding to the actual oil temperature. The motor current Im then reaches the current limit value IL before reaching the target rotation number Na and is maintained at the current limit value IL.

In this state, the motor rotation number Nm does not reach the target rotation number Na but is maintained at a rotation number that slightly exceeds the required rotation number on the low oil temperature characteristic line, and thus predetermined pump performance is secured.

At the time of satisfaction of the predetermined condition at step S1 after the control at step S2, the motor rotation number Nm is less than the required rotation number Np (≈target rotation number Na) corresponding to the indicated current Ip for the detected high oil temperature as illustrated in the figure.

Accordingly, determination of step S4 is NO, and calculation processing in which the motor current Im is increased is carried out at step S8. However, since the motor current Im already reaches the current limit value IL, the motor current Im is maintained at the current limit value IL, and predetermined pump performance can be maintained.

Figure 7:
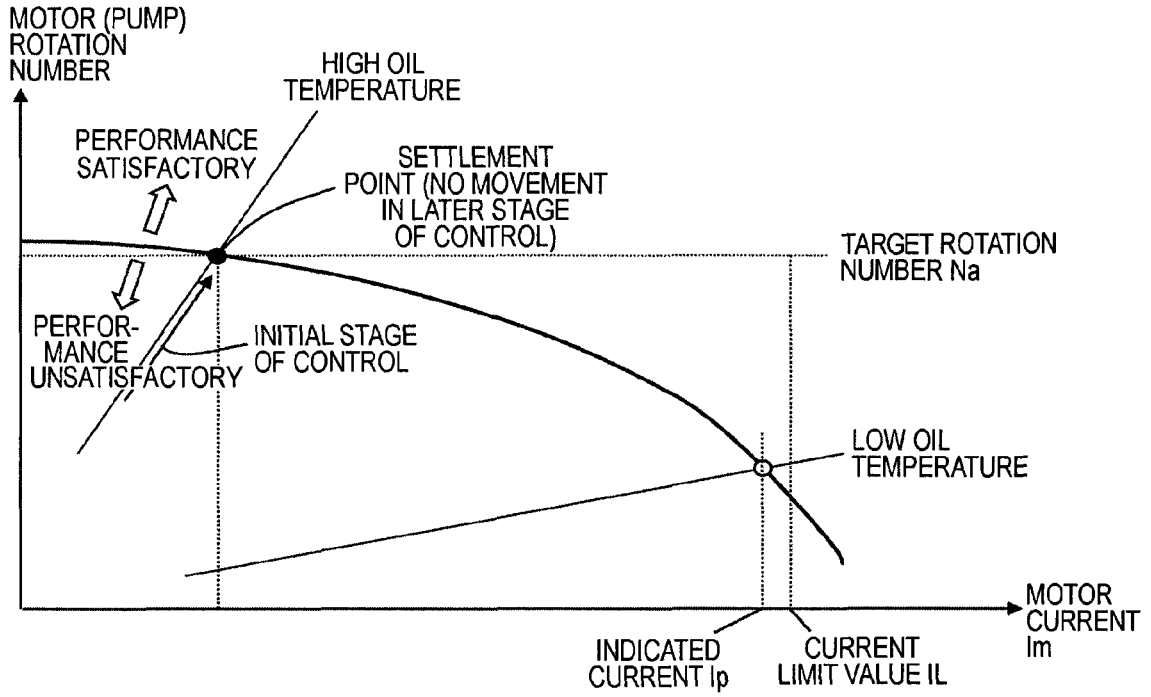
FIG. 7 illustrates pump operation when an oil temperature detected by the hydraulic pressure sensor is lower than an actual oil temperature in the control according to the first embodiment.

FIG. 7 is the opposite of FIG. 6 and illustrates a circumstance in which the oil temperature is detected as a low oil temperature due to abnormality of oil temperature sensor 11 although the actual oil temperature is a high oil temperature.

In this case, in an initial stage of control, the motor rotation number Nm moves on a high oil temperature characteristic line corresponding to the actual oil temperature and is settled in the target rotation number Na at the motor current Im that is less than the indicated current Ip corresponding to the detected low oil temperature, and predetermined pump performance is secured.

On the other hand, the motor rotation number Nm (≈target rotation number Na) is greater than the required rotation number Np corresponding to the indicated current Ip for the detected low oil temperature, and the motor current Im is less than the indicated current Ip.

Accordingly, in a later stage of the control, determination of step S4 is YES while determination of step S5 is NO, and the procedure goes to step S7. At this time, while the operation amount is increased when it is determined that the motor rotation number Nm does not reach the target rotation number Na, the operation amount is not increased and is maintained at a current value when it is determined that the motor rotation number Nm reaches the target rotation number Na. Thus, the motor current Im is increased or is maintained as it is, and predetermined pump performance is held secured.

Figure 8:
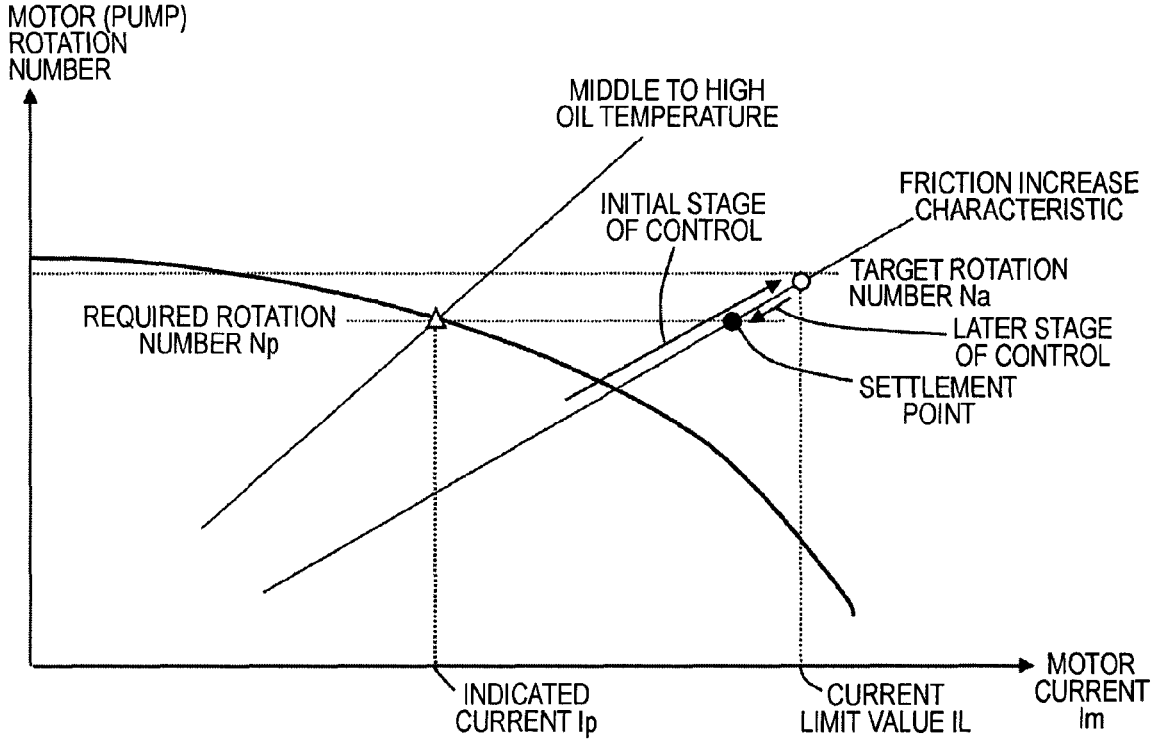
FIG. 8 illustrates pump operation when a pump characteristic is a characteristic of a friction increase due to deterioration or the like of the pump in the control according to the first embodiment.

FIG. 8 illustrates a circumstance in which oil temperature sensor 11 is normal, in which the actual oil temperature is a middle to high oil temperature, but in which the pump characteristic is a characteristic of a friction increase due to deterioration or the like of electric pump 8.

Here, in a case where the oil temperature is low, hydraulic pressure at the same rotation number rises due to an increase of viscosity, and thus the motor rotation number (pump rotation number) required to obtain predetermined performance is decreased. On the other hand, a friction increase due to deterioration or the like has nothing to do with rise of hydraulic pressure, and in order to obtain required hydraulic pressure in accordance with the actual oil temperature, motor current needs to be increased as much as an increase of rotational resistance.

In an initial stage of control, the motor rotation number Nm moves on a friction increase characteristic line along with an increase of the motor current Im, and when the motor rotation number Nm is settled in the vicinity of the target rotation number Na, the motor current Im reaches the vicinity of the current limit value IL.

After the above settlement of the motor rotation number Nm, the motor current Im is in the vicinity of the current limit value IL as described above and exceeds the indicated current Ip, and the motor rotation number Nm also exceeds the required rotation number Np corresponding to the indicated current Ip.

Accordingly, in a later stage of control, the motor current Im is decreased so as to be settled toward the indicated current Ip (steps S4 and S5→S6 in FIG. 4), but the motor current Im is increased when the motor rotation number Nm is the required rotation number Np or less due to a decrease of the motor current Im.

Accordingly, the motor current Im is settled (decreased) toward the indicated current Ip while the motor rotation number Nm is secured at the required rotation number Np or more.

That is, by increasing and correcting the motor current Im to a necessary and sufficient extent in accordance with the friction increase characteristic of electric pump 8, predetermined pump performance can be secured.

Alternatively, a configuration in which the motor current is controlled to be closer to the indicated current by controlling the current limit value to be variable after settlement of the motor rotation number Nm in an initial stage of control may be available.

Hereinafter, an embodiment in which the current limit value is controlled to be variable will be described.

Figure 9:
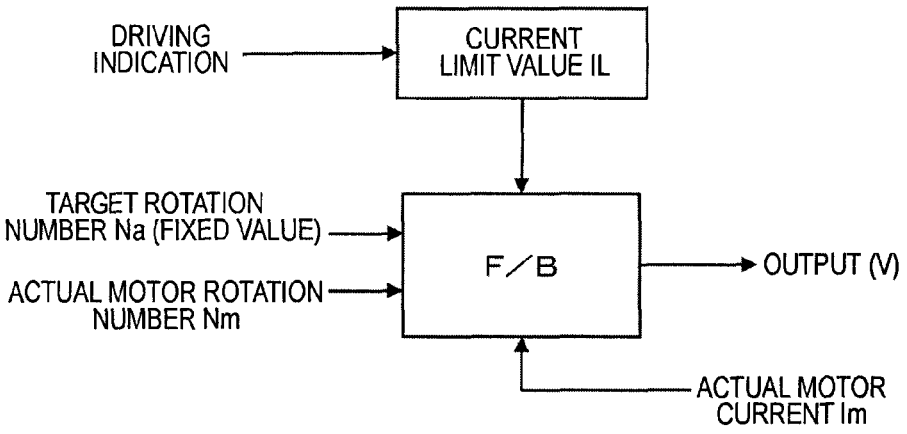
FIG. 9 is a control block diagram of a second embodiment.

FIG. 9 illustrates a control block diagram, in which electric pump 8 (driving circuit 83) sets the current limit value IL to be variable in response to a driving indication (indicated current) from CVTCU 5.

Figure 10:
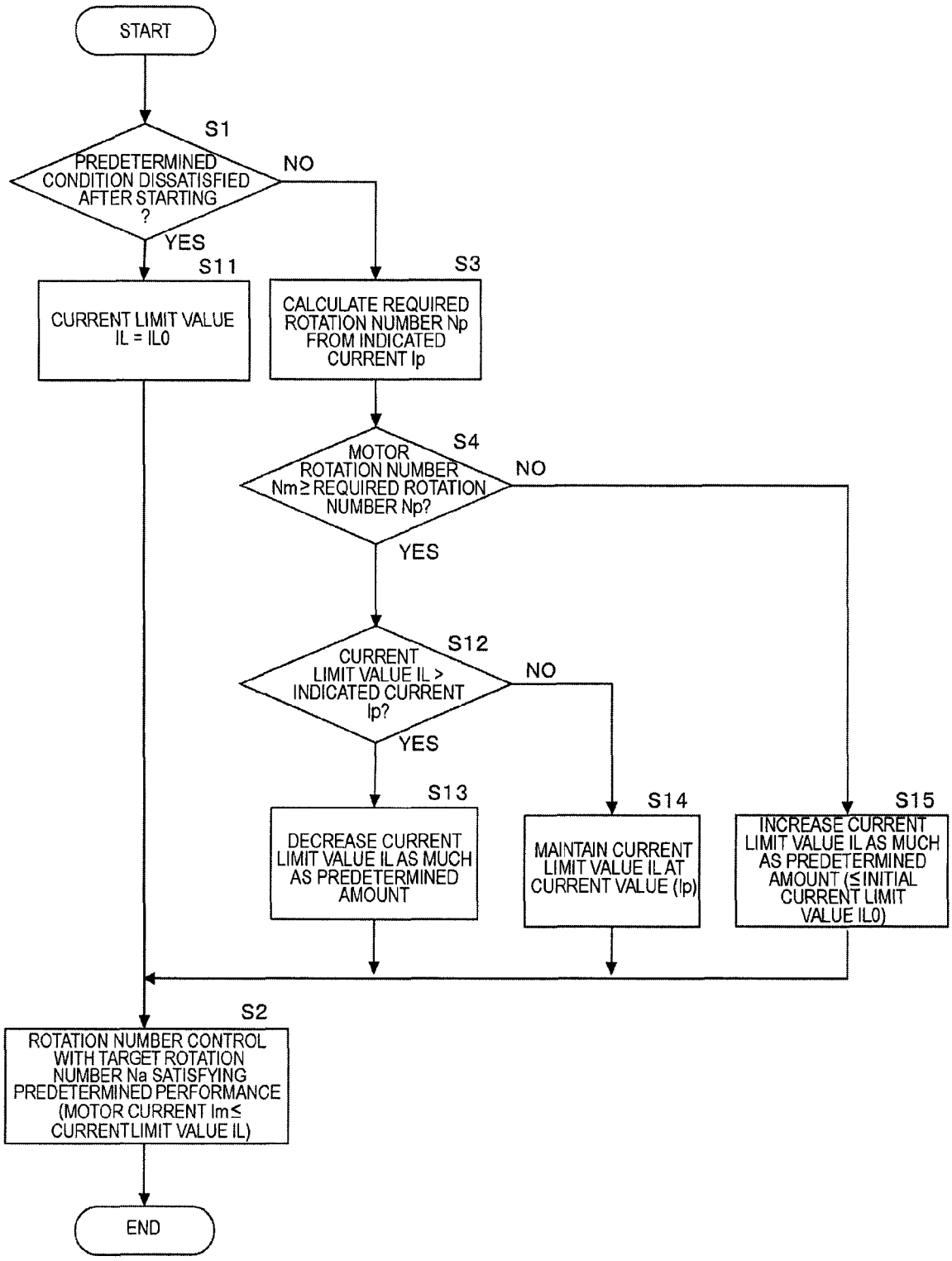
FIG. 10 is a flowchart of control according to the second embodiment.

FIG. 10 is a flowchart of a second embodiment illustrating basic control similar to FIG. 4.

Steps having identical functions to those in FIG. 4 are illustrated with the same numerals. Difference from FIG. 4 will be described mainly. After starting electric pump 8 at step S1, the current limit value IL is set to a pre-set value IL0 at step S11. This current limit value IL0 may be set to upper limit current in a motor (pump) operating region in a similar manner to the current limit value IL in FIG. 4. In the present embodiment, the current limit value IL is maintained at IL0 during control at step S2 but is set to be variable after satisfaction of the predetermined condition at step S1.

At step S2, feedback control to the target rotation number Na with a limitation by the current limit value IL0 is executed.

At step S3 and step S4, calculation of the required rotation number Np and comparison determination in number between the motor rotation number Nm and the required rotation number Np are carried out as described in FIG. 4.

When it is determined at step S4 that the motor rotation number Nm is greater than the required rotation number Np, the procedure goes to step S12, and it is determined whether the current limit value IL is greater than the indicated current Ip.

When it is determined that the current limit value IL is greater than the indicated current Ip, the procedure goes to step S13, and the current limit value IL is decreased as much as a predetermined value.

When the motor current Im decreases by the limitation by the decreased current limit value IL to cause the current limit value IL to be decreased to the indicated current Ip, determination of step S12 is YES, the procedure goes to step S14, and the current limit value IL is maintained at a current value (=indicated current Ip).

Also, in a case where the motor rotation number Nm is decreased to the required rotation number Np or less corresponding to the indicated current Ip before the motor current Im is decreased to the indicated current Ip, the procedure goes from step S4 to step S15, and the current limit value IL is increased as much as a predetermined value.

Figure 11:
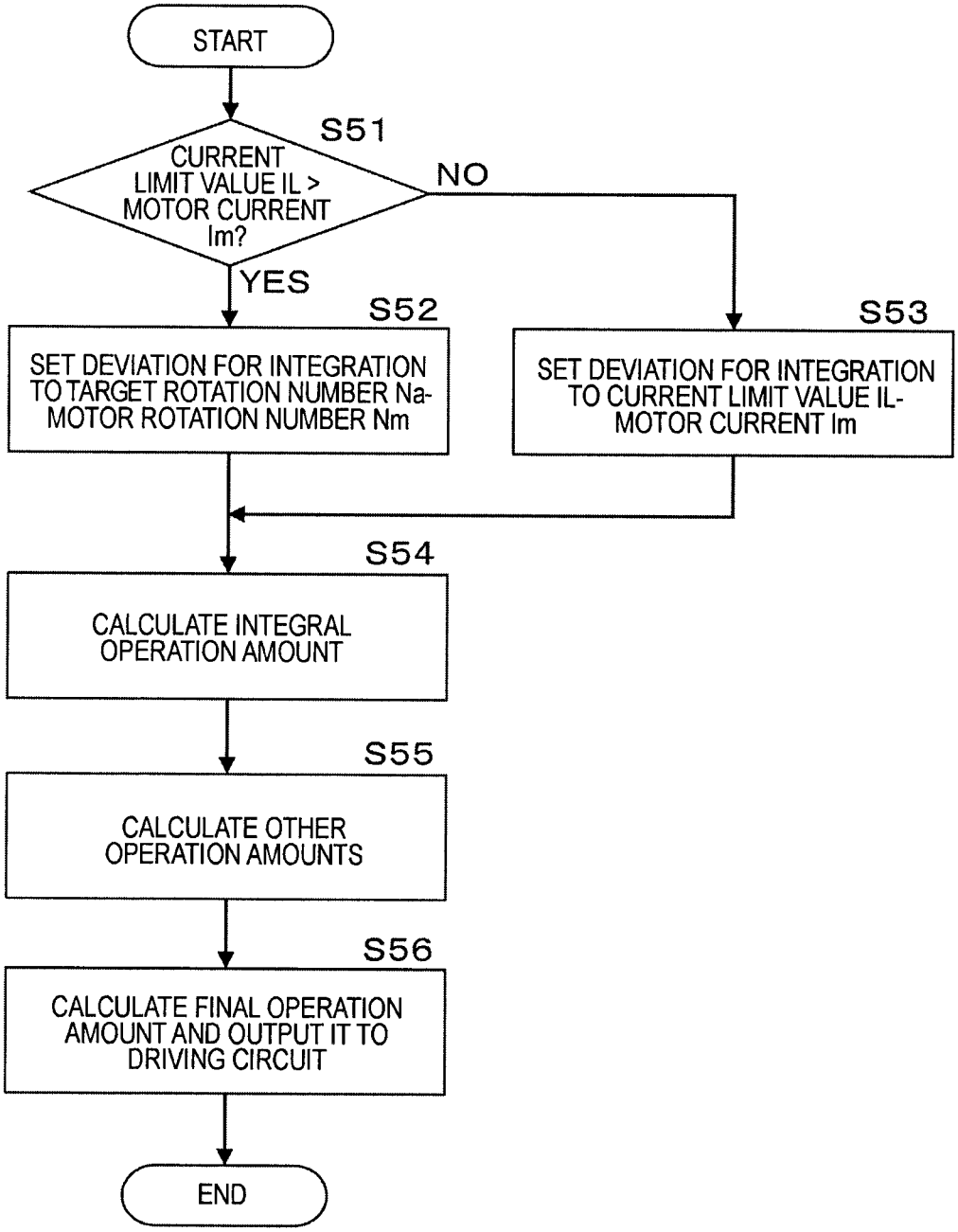
FIG. 11 is a flowchart of operation amount setting in the control according to the second embodiment.

FIG. 11 illustrates a flowchart of setting an operation amount (motor driving voltage) in the above control of the motor current Im with use of the current limit value IL that is controlled to be variable. This flowchart is used in common in embodiments following the present embodiment in which the current limit value IL is controlled to be variable.

At step S51, it is determined whether the current limit value IL is greater than the motor current Im.

When the current limit value IL is greater than the motor current Im, the procedure goes to step S52, and a deviation between the target rotation number Na and the motor rotation number Nm is used. That is, settlement of the motor current Im in the indicated current Ip by a limitation of the motor current Im by the current limit value IL is not started until the current limit value IL is decreased to the motor current Im in the processing at step S13 in FIG. 10, and during this period, the operation amount (motor driving voltage) set based on a deviation between the target rotation number Na and the motor rotation number Nm (=target rotation number Na—motor rotation number Nm) is output as it is.

After the current limit value IL is decreased to the motor current Im or less, the procedure goes to step S53, and the operation amount is set based on a deviation between the current limit value IL and the motor current Im (=current limit value IL—motor current Im<0). Thus, the operation amount (integral operation amount) calculated based on the above deviation of the rotation numbers is decreased and corrected, and the motor current Im is limited by the current limit value IL.

At step S54, the integral operation amount is calculated based on the deviation calculated at step S52 or step S53.

At step S55, other operation amounts such as an operation amount for proportion and an operation amount for differential are calculated as needed.

At step S56, a final operation amount (output voltage V of driving circuit 83) is calculated with use of these operation amounts to be output.

The above switching of the deviations enables smooth transition from initial control in which the motor rotation number Nm is settled in the target rotation number Na to later control in which the motor current Im is settled in the indicated current Ip while the motor current Im is made to follow the current limit value IL by an appropriate response.

Operations in the present embodiment in the respective circumstances illustrated in FIGS. 5 to 8 will be described.

In the circumstances in FIG. 5 (both the oil temperature sensor and the pump characteristic are normal) and FIG. 8 (the oil temperature sensor is normal, and the pump has the friction characteristic), the current limit value IL is decreased from a value in an initial stage of control (IL0, a white circle in each figure) to a final settlement point (a black circle in each figure), and the motor current Im starts with a settlement point in the initial stage of the control, follows the current limit value IL, and is decreased to a final settlement point (a black circle in each figure).

In the circumstance in FIG. 6 (the detected oil temperature is higher than the actual oil temperature and is abnormal), the current limit value IL is not decreased but is maintained at IL0 since the motor rotation number Nm is less than the required rotation number Np corresponding to the indicated current Ip even after completion of initial control, and the motor current Im is also maintained at the current limit value IL (=IL0).

In the circumstance in FIG. 7 (the detected oil temperature is lower than the actual oil temperature and is abnormal), the current limit value IL can be decreased from a value IL0 in an initial stage of control to the indicated current Ip in a later stage of the control, but the motor current Im is maintained at a value of a settlement point that is less than the current limit value IL in the initial stage of the control.

In the above manner, in any of the cases, after the motor rotation number Nm is increased to a rotation number enabling to obtain predetermined pump performance promptly in an initial stage of control to deal with an arbitrary circumstance, the motor current Im is decreased as much as possible while the predetermined pump performance is secured in a later stage of the control, thus to enable reduction in power consumption.

Also, as in the second embodiment (and after-mentioned third and fourth embodiments), by carrying out settlement of the motor current Im in the indicated current Ip by the current limitation with use of the current limit value IL, the settlement can be carried out easily without changing the control system.

Also, the first embodiment and the second embodiment (and an after-mentioned fourth embodiment) may be applied only to an abnormal case in which oil temperature sensor 11 is failed as illustrated in FIGS. 6 and 7, or in which the pump characteristic is the friction increase characteristic. Even in such an abnormal case, predetermined pump performance can be secured while electric pump 8 can be controlled, and both high responsiveness and reduction in power consumption can be achieved.

Figure 12:
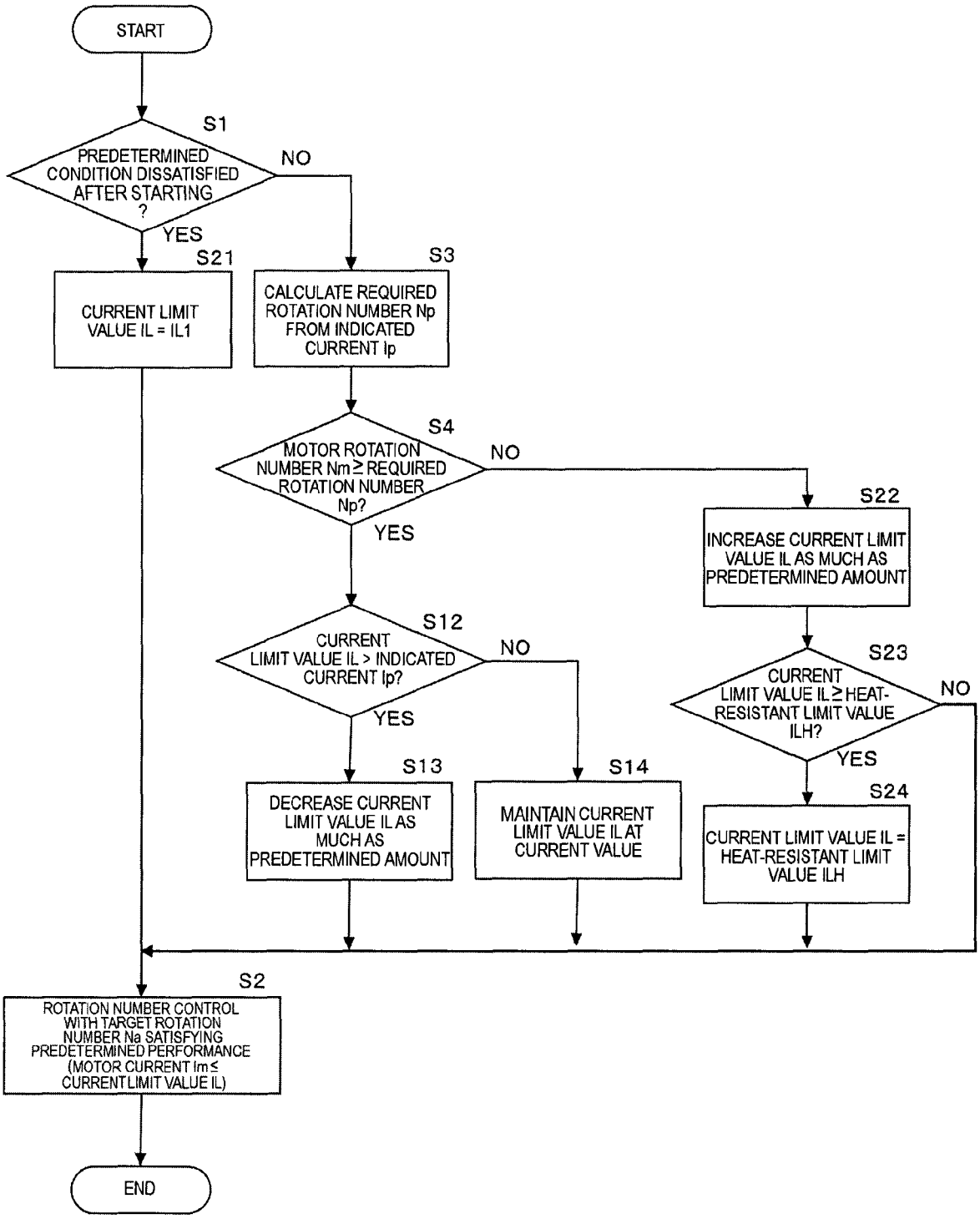
FIG. 12 is a flowchart of control according to a third embodiment.

FIG. 12 illustrates a flowchart of another embodiment (third embodiment) of control with use of the current limit value.

The present embodiment is applied in a case where it is confirmed by a separate test that the oil temperature sensor has no failure, and that the pump characteristic is normal (not the friction increase characteristic).

Steps having identical functions to those in the second embodiment in FIG. 10 are illustrated with the same numerals. Difference from FIG. 10 will be described mainly. After determination of dissatisfaction of the predetermined condition at step S1, the current limit value IL is varied and set to a value ILA corresponding to the command value (indicated current Ip) at step S21. That is, in a case where the oil temperature sensor and the pump characteristic are normal, an upper limit value of the motor current Im enabling to secure favorable responsiveness can be estimated in advance per indicated current Ip corresponding to the oil temperature in an initial stage of control. Thus, the current limit value IL is set to a value approximate to the upper limit value and is set to a greater value as the indicated current Ip is greater.

At step S2, rotation number control in which the motor rotation number Nm is settled in the target rotation number Na is carried out, and the motor current Im is limited by the current limit value IL (=IL1) that has been varied and set as above.

In this manner, by limiting the motor current Im by the current limit value IL set to a limit value required for securement of responsiveness per indicated current Ip, it is possible to restrict the motor current Im to be excessive even in an initial stage of control and to further reduce power consumption.

The current limit value IL (=IL1) in the initial stage of the control set in the above manner is settled in the indicated current Ip while the motor rotation number Nm is maintained at the required rotation number Np or more in a later stage of the control, and the motor current Im follows the current limit value IL and is settled in the indicated current Ip.

Also, when the motor rotation number Nm is less than the required rotation number Np, the current limit value IL is increased as much as a predetermined value at step S22, and in the present embodiment, it is determined at step S23 whether the increased current limit value IL is a heat-resistant limit value ILH or more. Here, the heat-resistant limit value ILH is set as an upper limit value of the motor current Im satisfying heat resistance in a normal operating state of electric pump 8 and is a smaller value than IL0, which corresponds to the aforementioned upper limit current.

When determination of step S23 is YES, the procedure goes to step S24, and the current limit value IL is made to be equal to the heat-resistant limit value ILH. That is, in a case where the current limit value IL required to secure predetermined pump performance with the motor rotation number Nm as the required rotation number Np or more reaches the heat-resistant limit value ILH or higher, the current limit value IL is limited to the heat-resistant limit value ILH to prioritize securement of heat resistance of electric pump 8.

This can improve a function to restrict deterioration caused by heat generation of electric pump 8.

Figure 13:
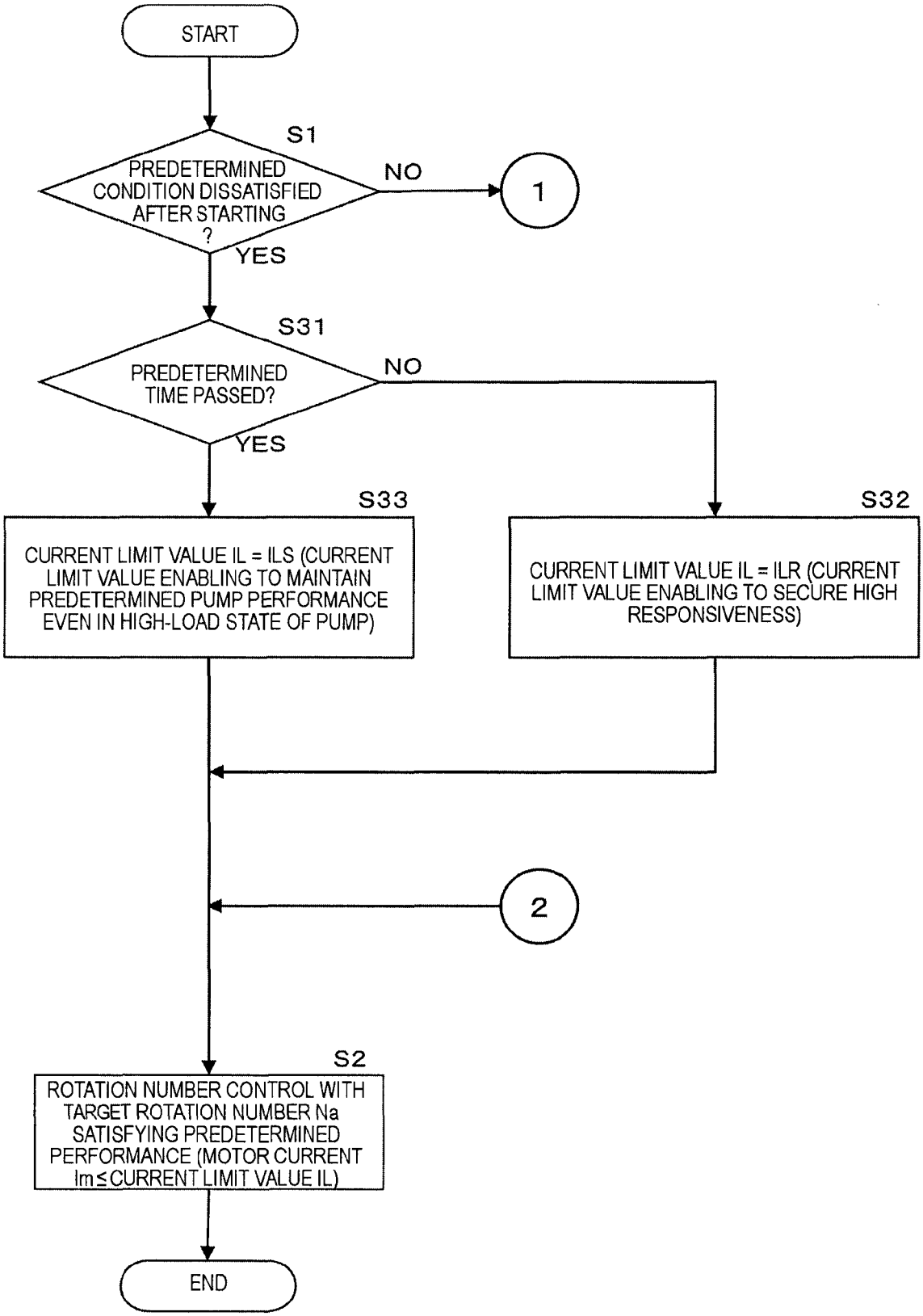
FIG. 13 is a flowchart illustrating a first half of control according to a fourth embodiment.
Figure 14:
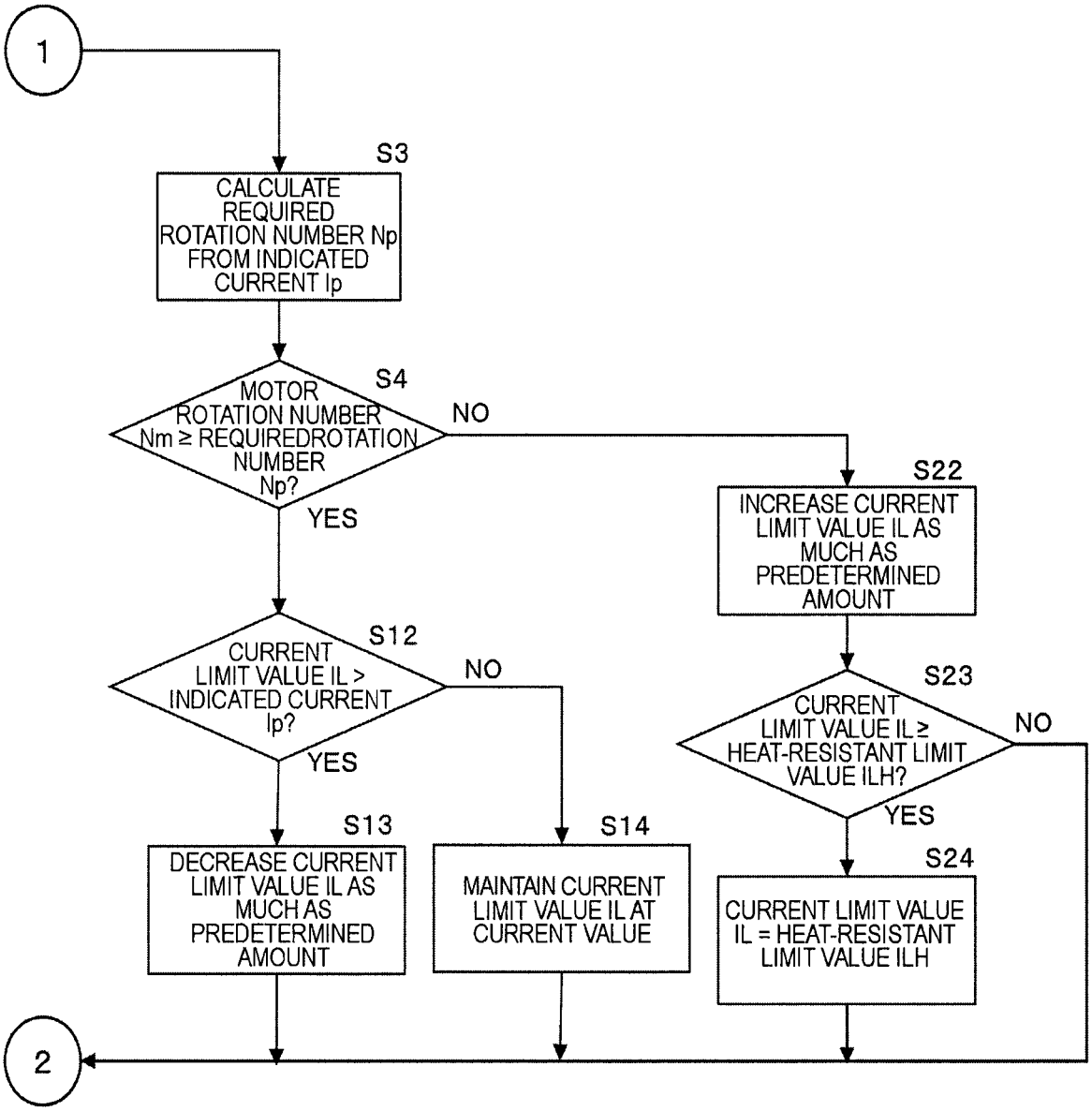
FIG. 14 is a flowchart illustrating a second half of the control according to the fourth embodiment.

FIGS. 13 and 14 illustrate flowcharts of still another embodiment (fourth embodiment) of control with use of the current limit value.

Steps having identical functions to those in the third embodiment in FIG. 12 are illustrated with the same numerals.

In the present embodiment, in an initial stage of control illustrated in FIG. 13, the current limit value IL is set in two levels in accordance with lapse of time after starting the pump. A later stage of the control illustrated in FIG. 14 is similar to that in the third embodiment.

After determination of dissatisfaction of the predetermined condition at step S1, it is determined at step S31 whether predetermined time has passed.

Before lapse of the predetermined time, the procedure goes to step S32, and the current limit value IL is set to a value ILR enabling to secure high responsiveness.

That is, in order to secure high responsiveness as a motor current characteristic, a rising current value needs to be greater to accelerate increase speed of the motor rotation number Nm. Thus, in predetermined time after starting the pump, the current limit value IL is set to the greater value ILR to alleviate a limitation of the motor current Im as much as possible. For example, ILR may be set to a value that is greater than IL0, which corresponds to the upper limit current in a normal pump operating region.

After lapse of the predetermined time after starting the pump and an increase of the motor rotation number Nm to a predetermined number or more, the procedure goes to step S33.

At step S33, the current limit value IL is switched and set to ILS (<ILR) enabling to maintain the motor rotation number Nm equal to or greater than a predetermined number and maintain pump performance even at the time of high-load operation of the pump (at the time of a low oil temperature, at the time of the friction increase characteristic, or the like).

At step S2, rotation number control with use of the target rotation number Na is carried out while the motor current Im is limited by the current limit value IL switched and set in accordance with lapse of time as described above.

With the present embodiment, it is possible to secure high responsiveness and to reduce power consumption even in the initial stage of the control.

Although the above embodiments have been described by applying the embodiments to an apparatus for controlling an electric pump for generation of transmission hydraulic pressure, the embodiments can also be applied to an apparatus for controlling an electric pump for use in cooling a traveling motor of a hybrid car or an inverter or the like in a similar manner, and a similar effect can be obtained.

The entire contents of Japanese Patent Application No. 2012-64153, filed Mar. 21, 2012, are incorporated herein by reference.

While only a select embodiment has been chosen to illustrate the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and not for the purpose of limiting the invention, the invention as claimed in the appended claims and their equivalents.

What is claimed is:

1. An apparatus for controlling an electric pump supplying operating oil, comprising: an oil temperature sensor that detects a temperature of the operating oil; and a control unit that receives a detection signal from the oil temperature sensor, and that controls a motor, the motor driving the electric pump, wherein the control unit performs: an initial stage of control in which a rotation number of the electric pump is settled toward a target rotation number that ensures a predetermined pump performance; and a later stage of control in which after settlement of the rotation number of the electric pump toward the target rotation number through the initial stage of control, a command value of current of the motor is set based on an oil temperature detected by the oil temperature sensor, a reference rotation number is set based on the command value, and in which when the rotation number of the electric pump is smaller than the reference rotation number, the current of the motor is increased, when the rotation number of the electric pump is greater than the reference rotation number and the current of the motor is higher than the command value, the current of the motor is decreased, and when the rotation number of the electric pump is greater than the reference rotation number and the current of the motor is lower than the command value, the current of the motor is increased.

2. The apparatus for controlling an electric pump according to claim 1, wherein the control unit sets the target rotation number to a rotation number satisfying an upper limit performance in an operating region of the electric pump.

3. The apparatus for controlling an electric pump according to claim 1, wherein the control unit limits motor current of the electric motor by a current limit value set to a greater value than the command value in the initial stage of control.

4. The apparatus for controlling an electric pump according to claim 3, wherein the control unit performs the settlement of the motor current to the command value by changing the current limit value so as to be settled to the command value.

5. The apparatus for controlling an electric pump according to claim 3, wherein the control unit sets the current limit value in the initial stage of the pump starting in accordance with a magnitude of the command value.

6. The apparatus for controlling an electric pump according to claim 3, wherein in a case in which the motor current, when the rotation number of the electric pump reaches the reference rotation number, is greater than a heat-resistant limit value, the control unit allows a decrease of the rotation number of the electric pump until the current of the motor is less than the heat-resistant limit value.

7. The apparatus for controlling an electric pump according to claim 3, wherein the control unit sets a motor driving voltage based on a deviation between the target rotation number and the rotation number of the electric pump when the motor current is equal to or less than the current limit value and sets the motor driving voltage based on a deviation between the motor current and the current limit value when the motor current of the motor is greater than the current limit value.

8. An apparatus for controlling an electric pump supplying operating oil, comprising:

oil temperature detecting means for detecting a temperature of the operating oil, and control means that: i) receives a detection signal from the oil temperature detecting means, and ii) controls a motor that drives the electric pump, wherein the control means includes:

initial stage control means that settle a rotation number of the electric pump toward a target rotation number that ensures a predetermined pump performance; and later stage control means that set, after settlement of the rotation number of the electric pump toward the target rotation number by use of the initial stage control means, a command value of current of the motor based on an oil temperature detected by the oil temperature detecting means, set a reference rotation number based on the command value, and in which when the rotation number of the electric pump is smaller than the reference rotation number, the current of the motor is increased, when the rotation number of the electric pump is greater than the reference rotation number and the current of the motor is higher than the command value, the current of the motor is decreased, and when the rotation number of the electric pump is greater than the reference rotation number and the current of the motor is lower than the command value, the current of the motor is increased.

9. A method of controlling an electric pump supplying operating oil, comprising the steps of: settling a rotation number of the electric pump toward a target rotation number that ensures a predetermined pump performance; detecting a temperature of the operating oil; setting a command value of current of a motor based on the temperature of the operating oil; setting a reference rotation number of the electric pump based on the command value; after settlement of a rotation number of the electric pump toward the target rotation number, when the rotation number of the electric pump is smaller than the reference rotation number, increasing the current of the motor, after settlement of the rotation number of the electric pump toward the target rotation number, when the rotation number of the electric pump is greater than the reference rotation number and the current of the motor is higher than the command value, decreasing the current of the motor, and after settlement of the rotation number of the electric pump toward the target rotation number, when the rotation number of the electric pump is greater than the reference rotation number and the current of the motor is lower than the command value, increasing the current of the motor.

10. The method of controlling an electric pump according to claim 9, wherein the step of settling the rotation number of the electric pump toward the target rotation number is setting the target rotation number to a rotation number satisfying upper limit performance in an operating region of the electric pump.

11. The method of controlling an electric pump according to claim 9, wherein the step of settling the rotation number of the electric pump toward the target rotation number is limiting the current of the motor by a current limit value set to a greater value than the command value in the initial stage of the pump starting.

12. The method of controlling an electric pump according to claim 11, wherein the step of settling the current of the motor to be closer to the command value is performing the settlement of the current of the motor to the command value by changing the current limit value so as to be settled to the command value.

13. The method of controlling an electric pump according to claim 11, wherein the step of controlling a rotation number of the electric pump is setting the current limit value in the initial stage of the pump starting in accordance with magnitude of the command value.

14. The method of controlling an electric pump according to claim 11, wherein the step of settling the current of the motor to be closer to the command value is, in a case in which the current of the motor, when the rotation number of the electric pump reaches the reference rotation number, is greater than a heat-resistant limit value, allowing a decrease of the rotation number of the electric pump until the current of the motor is less than the heat-resistant limit value.

15. The method of controlling an electric pump according to claim 11, wherein the step of settling the rotation number of the electric pump toward the target rotation number is setting a motor driving voltage based on a deviation between the target rotation number and the rotation number of the electric pump when the current of the motor is equal to or less than the current limit value, and setting the motor driving voltage based on a deviation between the current of the motor and the current limit value when the current of the motor is greater than the current limit value.

16. The apparatus for controlling an electric pump according to claim 1, wherein when in the later stage of control, the rotation number of the electric pump is greater than the reference rotation number, in a case in which the current of the motor is greater than the command value, the control unit decreases the current of the motor, while in a case in which the current of the motor is less than the command value, the control unit increases the current of the motor.

17. The apparatus for controlling an electric pump according to claim 1, wherein when in the later stage of control, the rotation number of the electric pump is less than the reference rotation number, the control unit increases the current of the motor.

18. The method of controlling an electric pump according to claim 9, wherein the step of settling the current of the motor to be closer to the command value includes the steps of:

decreasing, when the rotation number of the electric pump is greater than the reference rotation number, the current of the motor in a case in which the current of the motor is greater than the command value; and increasing the current of the motor in a case in which the current of the motor, when the rotation number of the electric pump is greater than the reference rotation number, is less than the command value.

19. The method of controlling an electric pump according to claim 9, wherein the step of settling the current of the motor to be closer to the command value includes the step of increasing, when the rotation number of the electric pump is less than the reference rotation number, the current of the motor.

20. The apparatus for controlling an electric pump according to claim 1, wherein in the later stage of control: i) the current of the motor is decreased with respect to the current of the motor prior to the later stage of control, so as to be settled toward an indicated current, and ii) the current of the motor is increased when the rotation number of the electric pump is the required rotation number or less.

* * * * *